US006070988A

United States Patent [19]

Okamura

[11] Patent Number: 6,070,988

[45] Date of Patent: Jun. 6, 2000

[54] CONTROL PANEL FOR AN IMAGE FORMING DEVICE

[75] Inventor: Mike H. Okamura, Boise, Id.

[73] Assignee: Hewlett-Packard Company, Palo Alto, Calif.

[21] Appl. No.: 09/233,296

[22] Filed: Jan. 19, 1999

[51] Int. Cl.[7] ..... F21V 33/00; G08B 21/00

[52] U.S. Cl. ..... 362/85; 362/23; 362/29; 340/635; 340/815.4; 340/815.47; 340/815.52

[58] Field of Search ..... 362/85, 23, 29; 116/306, 307, 321, 323; 358/1.1; 340/635, 815.4, 815.47, 815.52

[56] References Cited

U.S. PATENT DOCUMENTS 5,793,298 8/1998 Matsuura ..... 340/679

5,940,652 8/1999 Hirikawa ..... 399/8

*Primary Examiner*—Sandra O'Shea
*Assistant Examiner*—Ronald E. DelGizzi

[57] ABSTRACT

A control panel that includes printed information cards used in conjunction with status indicators to give the user detailed information about printer operations. The invented control panel includes a series of status indicators, such as the indicator lights used on low cost printers, and a corresponding series of card holders. Each card holder is linked to one of the status indicators by, for example, positioning each card holder immediately adjacent to the corresponding status indicator. One or more information cards are attached to each card holder. Where more than one information card is used with a single card holder, each card is, preferably, swing mounted to the card holder so that the user can flip through the cards to view pertinent information.

11 Claims, 2 Drawing Sheets

CONTROL PANEL FOR AN IMAGE FORMING DEVICE

FIELD OF THE INVENTION

The invention relates generally to image forming devices and, more particularly, to a control panel that utilizes printed information cards to communicate important information to the user.

BACKGROUND OF THE INVENTION

Printers, copiers and other image forming devices include some type of control panel that communicates the status of printer functions to the user. The control panel may also allow the user to exercise some degree of control over printer functions. In low cost devices, the control panel often includes only a series of status indicator lights, corresponding icons and brief printed legends to communicate the status of basic printer functions or alert the user to basic problems. For example, a low cost printer might include an indicator light and icon for "error" to indicate a problem such as a paper jam and an indicator light for "paper" to indicate an empty paper cassette. In more sophisticated and expensive devices, the control panel usually includes a graphical display and a keypad to communicate more detailed information to the user and, in some cases, allow the user to control basic printer functions. For example, many mid to high cost printers and copiers include a graphical display that can display two lines of up to sixteen characters. Using the keypad, the user can scroll through different options and menus to determine the status of printer functions, troubleshoot problems and the like.

The very limited information communicated to users through the indicator light/icon control panels of low cost printers is not adequate for more complex printers, particularly even low cost color laser printers. Icons are hard for many users to understand and the limited information available does not convey easy to understand information about replacing and reordering consumables, locating and clearing jams, loading paper and troubleshooting printer operations. Even the graphical displays on more expensive printing devices cannot communicate the detailed text and pictorial information to help the user locate and clear paper jams, access and replace consumables or troubleshoot printer problems. In either case, only limited information can be communicated electronically to the user. Hence, the user must often refer to the printer manual to determine and respond to all but the most basic events or problems communicated electronically from the control panel.

One solution to this problem of limited electronic communications to the user is printed information cards. Some copiers, for example, include a set of information cards that contain text and pictures to give the user detailed information. The cards are used in conjunction with the graphical display panel. For example, an error code is displayed on the control panel directing the user to the appropriate information card. The information card includes the detailed information that allows the user to locate and correct the error. The information cards are housed as individual cards or a booklet in a pocket or drawer somewhere about the exterior housing of the copier.

SUMMARY OF THE INVENTION

The present invention is directed to a control panel that includes printed information cards used in conjunction with status indicators to give the user detailed information about printer operations. The invented control panel includes a series of status indicators, such as the indicator lights used on low cost printers, and a corresponding series of card holders. Each card holder is linked to one of the status indicators by, for example, positioning each card holder immediately adjacent to the corresponding status indicator. One or more information cards are attached to each card holder. Where more than one information card is used with a single card holder, each card is, preferably, swing mounted to the card holder so that the user can flip through the cards to view pertinent information.

DETAILED DESCRIPTION OF THE INVENTION

Figure 1:
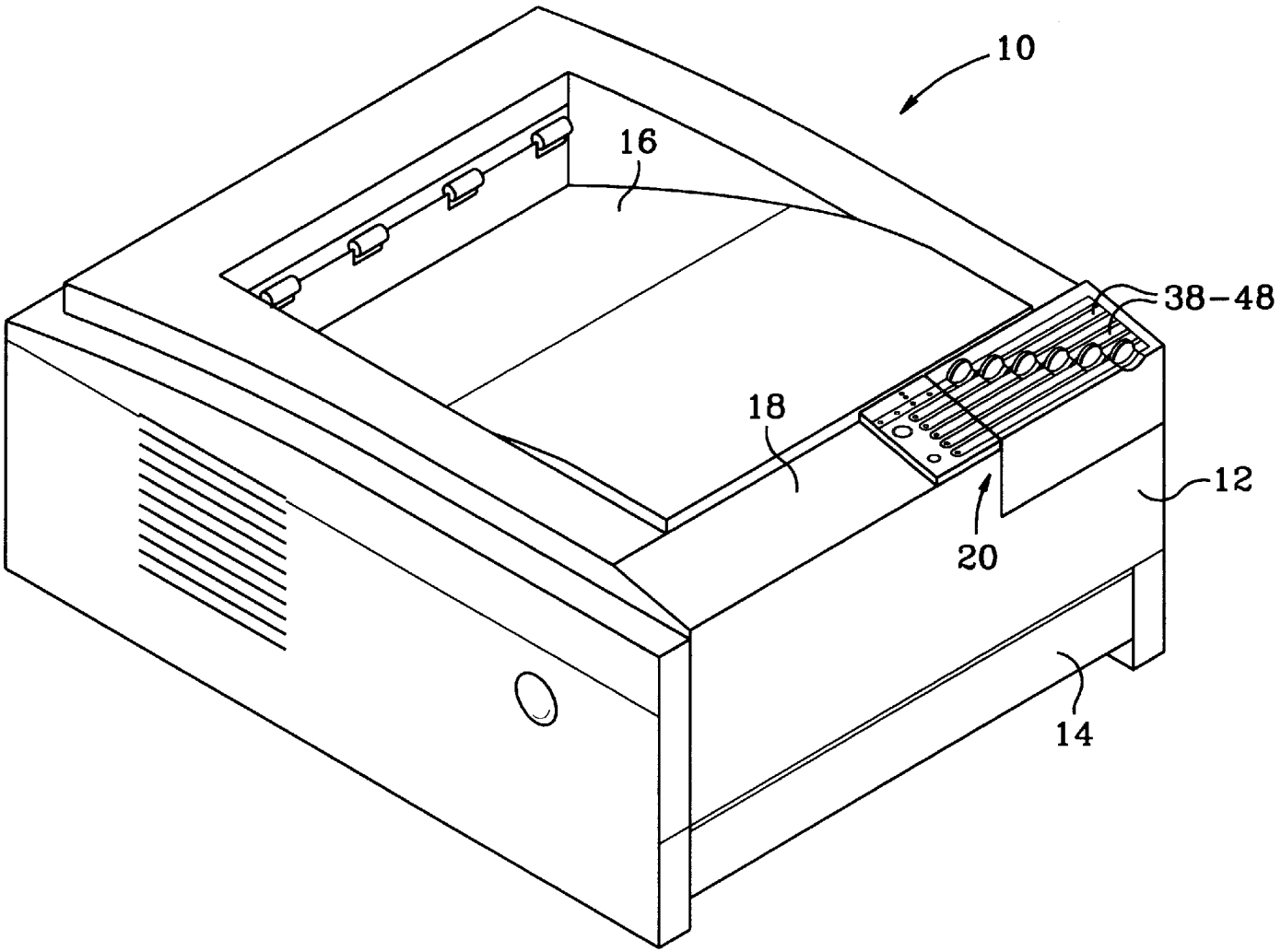
FIG. 1 is a perspective view of a printer with a control panel constructed according to one embodiment of the invention.

Referring to FIG. 1, printer 10 includes a main housing 12 and a paper cassette 14. Paper cassette 14 slides into and out of the lower part of main housing 12. Sheets of paper are pulled from cassette 14 into the print engine components housed in housing 12 where the desired image is formed on each sheet. The printed sheets are outputted to a paper collection area 16 located in the top portion 18 of main printer housing 12.

Figure 2:
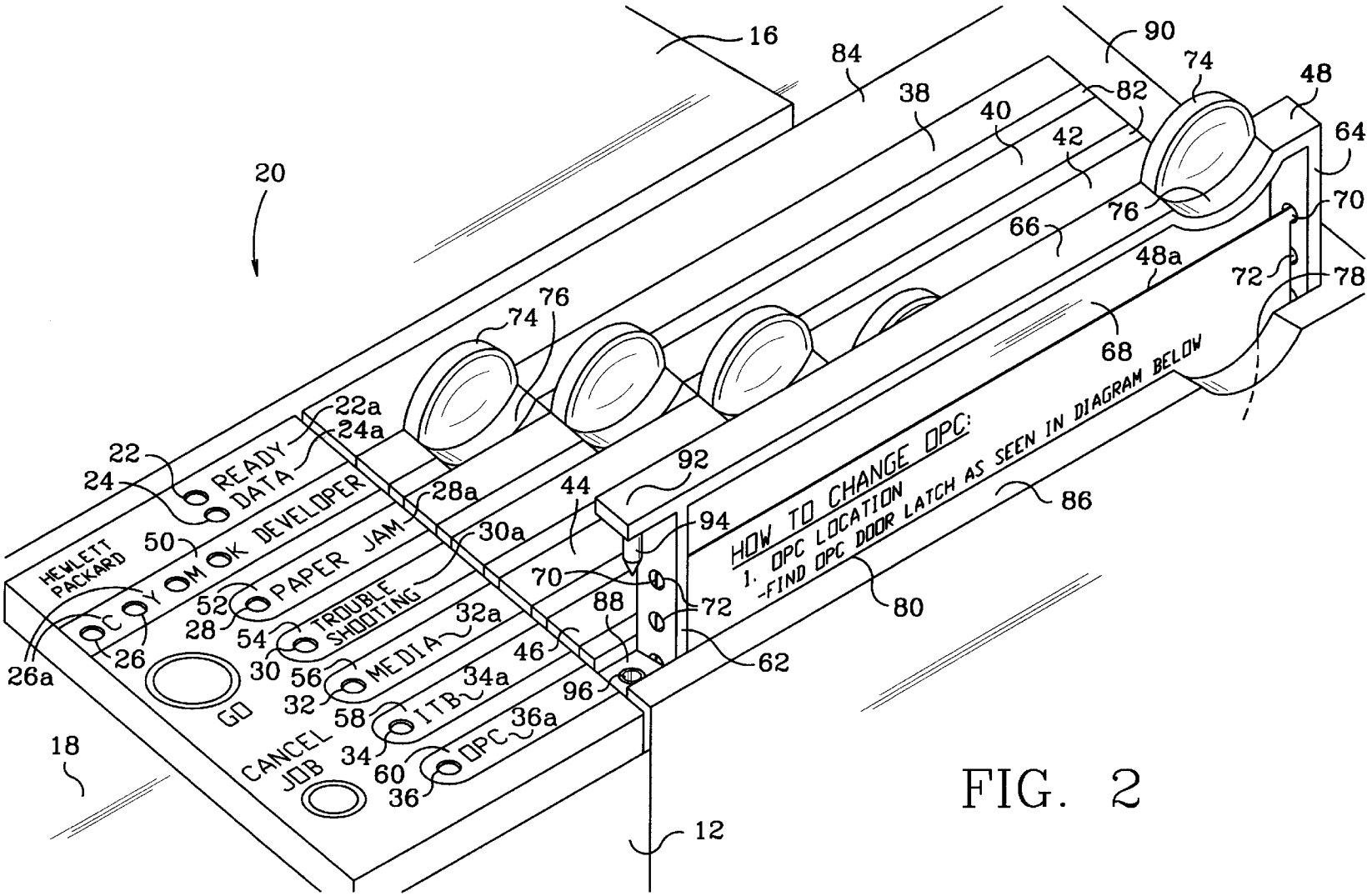
FIG. 2 is a detail perspective view of the control panel on the printer of FIG. 1.

Referring to FIGS. 1 and 2, a status and control panel 20 is located along the front top portion of main housing 12. Control panel 20 includes conventional electronic control circuitry (not shown) in housing 12. Status indicators 22–36 are connected to the control circuitry. In the embodiment shown in FIGS. 1 and 2, the status indicators 22–36 are lights. In more sophisticated (and costly) printers, a graphical display window connected to the control circuitry as part of control panel 20 is often used to indicate printer status and events. Indicator lights 22–36, which are usually light emitting diodes (LEDs), indicate the status or readiness of the various components and functions of printer 10 noted on a legend 22*a*–36*a* next to each light 22–36. For example, light 22 indicates the readiness of printer 10 as noted by the "READY" legend 22*a*. When light 22 is on, printer 10 is ready to print. When light 22 is not on, printer 10 is not ready to print.

Light 24 indicates whether data is being received or has been received by printer 10 as noted by the "DATA" legend 24*a*. Lights 26 indicate the status of each of the color toner cartridges in printer 10 as noted by the "C" (cyan), "Y" (yellow), "M" (magenta) and "K" (black) legends 26*a*. Light 28 indicates if there is a paper jam as noted by the "PAPER JAM" legend 28*a*. Light 30 indicates whether trouble shooting is necessary as noted by the "TROUBLE-SHOOTING" legend 30*a*. Light 32 indicates the paper cassette is empty, single sheet feeding and other media related events as noted by the "MEDIA" legend 32*a*. Light 34 indicates the status of the intermediate transfer belt as noted by the "ITB" legend 34*a*. Light 36 indicates the status of the organic photoconductive drum as noted by the "OPC" legend 36*a*.

A series of card holders 38, 40, 42, 44, 46 and 48 are located in housing 12 immediately adjacent to indicator lights 26–36. Each card holder 38–48 is linked to at least one of the status indicators. In the preferred embodiment shown in FIGS. 1 and 2, the card holders are linked to the status indicators by locating each card holder 38–48 immediately adjacent to a corresponding indicator light 26–36. Indicator lights 26–36 and the corresponding legends 26*a*–36*a* may be positioned on or in optional strips 50, 52, 54, 56, 58 and 60 formed along the top portion of housing 12. Strips 50–60 are generally the same width as card holders 38–48 and aligned with each card holder to present a more direct visual correspondence to the user between each indicator light and the corresponding card holder.

One or more information cards are mounted on or affixed to each card holder. For example, information card 48*a* is swing mounted to holder 48 as shown in FIG. 2. Instructions for changing the OPC are printed on card 48*a*. In the embodiment of FIG. 2, each holder 38–48 includes side rails 62 and 64, a top rail 66 and a back panel 68. Tabs 70 project from each side of the top of card 48*a*. Tabs 70 are inserted into holes 72 formed along each side rail 62, 64 of card holders 38–48. The information cards hang from tabs 62 as illustrated by card 48*a* in holder 48. The tabs and holes are configured relative to one another such that the information cards will swing freely in the holder. In this way, each information card in a series of cards mounted in each holder may be viewed by flipping up the preceding card or cards.

A gripper 74 is formed along top rail 66 of card holders 38–48. Gripper 74 projects up from top rail 66. A complementary depression 76 in top rail 66 may be used to make it easier for the user to pull up each card holder. Preferably, the grippers 74 are staggered diagonally along the holders to allow the user to easily grasp each gripper.

Holders 38–48 are housed in a card well 78 in printer housing 12. Card well 78 represents generally any suitable structure in housing 12 for supporting and containing the card holders. In the preferred embodiment of the invention shown in FIG. 2, each holder 38–48 slides up and down in a rectangular slot 80. Each slot 80 is bounded along its length by dividers 82 for the interior holders, a divider 82 and back wall 84 for holder 38 and a divider 82 and front wall 86 for holder 48. Each slot 80 is bounded on the sides by blocks 88 and sidewall 90. Preferably, blocks 88 are recessed to the thickness of top rail 66 so that an end portion 92 of each top rail 66 may extend over each block 88 while remaining flush with the top of the printer housing. A pin 94 projecting down from the end 92 of each top rail 66 fits into a mating hole 96 in each block 88 to help maintain the alignment of each holder 38–48 as it slides up and down through slots 80 in card well 78.

While the present invention has been shown and described with reference to the foregoing preferred embodiment, it is to be understood that other forms and details may be made thereto without departing from the spirit and scope of the invention. For example, the control panel of the present invention is not limited to use with a printer. The control panel could be used with a copier, fax machine, multi-function printing device or any other image forming device in which it is necessary or desirable to provide the user with information about different printing events or problems. The invention is also not limited to devices that use only status indicator lights on the control panel to communicate status and events to the user. The invented card holder and information cards could also be incorporated into a control panel in which the status indicators are displayed graphically to the user. Each card holder, for example, could be linked to the status indicators by labeling each card holder accordingly to corresponding status and error codes displayed graphically to the user. It should be understood, therefore, that the invention is to be construed broadly within the scope of the following claims.

What is claimed is:

1. A control panel for an image forming device, comprising:

a plurality of status indicators;

a plurality of card holders, each card holder linked to one of the status indicators; and at least one information card attached to each card holder.

2. The control panel of claim 1, further comprising a ready indicator and a data indicator.

3. The control panel of claim 1, wherein the at least one information card comprises a plurality of information cards swingingly mounted to the card holder.

4. The control panel of claim 1, wherein each card holder is disposed adjacent to a corresponding one of the status indicators.

5. The control panel of claim 1, further comprising:

a housing disposed at least partially adjacent to the status indicators; and a plurality of slots in the housing, each card holder movably disposed in a corresponding one of the slots.

6. The control panel of claim 4, wherein the status indicators comprise lights.

7. The control panel of claim 5, wherein each card holder includes a gripper protruding outside the housing.

8. The control panel of claim 5, wherein each card holder is movable between a first position in which the information cards are substantially fully housed within the housing and a second position in which a substantial portion of the cards are exposed outside the housing.

9. A control panel for an image forming device having an exterior housing, the control panel comprising:

status indicators disposed visible on a first planar portion of the housing;

elongated openings in a second deeper portion of the housing adjacent to the first portion of the housing, each opening aligned with a corresponding one of the status indicators;

card holders housed in the openings; and information cards held by the card holders.

10. A control panel for an image forming device having an exterior housing, the control panel comprising:

a plurality of indicator lights visible on the housing;

a plurality of information card holders slidably mounted in the housing adjacent to corresponding ones of the indicator lights;

one or more information cards swingingly mounted to each card holder; and each card holders slidable between a first position in which the information cards are substantially fully housed within the housing and a second position in which a substantial portion of the cards are exposed outside the housing.

11. The control panel according to claim 10, further comprising a plurality of legends disposed on the first portion of the housing adjacent to corresponding ones of the indicator lights.

* * * * *